US009283748B2

(12) United States Patent
Umeda et al.

(10) Patent No.: US 9,283,748 B2
(45) Date of Patent: Mar. 15, 2016

(54) PRINTHEAD AND PRINTING APPARATUS

(71) Applicant: CANON KABUSHIKI KAISHA, Tokyo (JP)

(72) Inventors: Kengo Umeda, Tokyo (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/258,215

(22) Filed: Apr. 22, 2014

(65) Prior Publication Data

US 2014/0327717 A1 Nov. 6, 2014

(30) Foreign Application Priority Data

May 2, 2013 (JP) ..... 2013-097115

(51) Int. Cl.
*B41J 2/045* (2006.01)

(52) U.S. Cl.
CPC ..... *B41J 2/04563* (2013.01); *B41J 2/0458* (2013.01); *B41J 2/04541* (2013.01); *B41J 2/04581* (2013.01); *B41J 2202/20* (2013.01); *B41J 2202/21* (2013.01)

(58) Field of Classification Search
None
See application file for complete search history.

(56) References Cited

U.S. PATENT DOCUMENTS

| | | | | |
|---|---|---|---|---|
| 5,960,191 | A * | 9/1999 | Sample et al. | 703/28 |
| 7,404,612 | B2 | 7/2008 | Takamiya et al. | |
| 7,802,865 | B2 | 9/2010 | Takamiya et al. | |
| 8,147,039 | B2 | 4/2012 | Kurokawa et al. | |
| 2012/0162317 | A1 | 6/2012 | Hirayama et al. | |

FOREIGN PATENT DOCUMENTS

| | | |
|---|---|---|
| JP | 2007-069575 A | 3/2007 |
| JP | 2012-121184 A | 6/2012 |

OTHER PUBLICATIONS

Machine translation of JP 2012-121184 A. (JP 2012-121184 A was published on Jun. 28, 2012.).*

* cited by examiner

*Primary Examiner* — Justin Seo
(74) *Attorney, Agent, or Firm* — Fitzpatrick, Cella, Harper & Scinto

(57) ABSTRACT

A printhead includes a plurality of element substrates, each including a plurality of printing elements, arranged in the arrayed direction of the printing elements. Each element substrate includes a temperature detection element for detecting the temperature of the element substrate. The printhead includes a head control IC connected to each element substrate and configured to control driving of the printing elements integrated on the element substrates. The head control IC and the element substrates are connected via a head terminal by a signal wire for transferring a signal between the head control IC and each element substrate. A temperature detection signal output from the temperature detection element and an image data signal are multiplexed on part of the signal wires.

11 Claims, 13 Drawing Sheets

LVDS SIGNAL TRANSFER MODE (DATA=High)

LVDS SIGNAL TRANSFER MODE (DATA=Low)

TEMPERATURE DETECTION SIGNAL TRANSFER MODE

PRINTHEAD AND PRINTING APPARATUS

BACKGROUND OF THE INVENTION

1. Field of the Invention

The present invention relates to a printhead and a printing apparatus and, more particularly, to printhead that performs printing in accordance with, for example, an inkjet method and a printing apparatus that performs printing using the same.

2. Description of the Related Art

The element substrate of a printhead included in an inkjet printing apparatus (to be referred to as a printing apparatus hereinafter) is formed from a semiconductor integrated circuit. The ink discharge amount is known to increase as the temperature of the element substrate rises. On the other hand, a printing apparatus is required to guarantee reproducibility and color stability of printed images even in continuous printing. There has conventionally been proposed a technique of precisely controlling the driving voltage or driving pulse of a printhead (see Japanese Patent Laid-Open No. 2007-069575). With this technique, a signal processing circuit of a printing apparatus coordinates the driving condition (driving voltage or driving pulse) of printing elements based on temperature data detected by a temperature detection element integrated on an element substrate and controls to uniform the ink discharge amount.

To implement printing at a higher speed, there has been proposed a technique of increasing the print width of a printhead by arranging a plurality of element substrates in the arrayed direction of printing elements. An example of this proposal is a full-line printhead having a print width equal to or more than the width of a print medium in advance. A full-line printhead enables high-speed printing because its printhead need not be scanned, and is finding increased use in printing apparatuses for business or industrial application purposes. A technique of including a temperature detection element on each element substrate of the full-line printhead and individually detecting the temperature of each element substrate has been proposed (see Japanese Patent Laid-Open No. 2012-121184).

A plurality of element substrates are included on the printhead. For this reason, when a temperature detection element is provided on each element substrate, wires for the temperature detection elements are necessary as many as the number of element substrates, and the number of terminals and the number of wires provided on the head largely increase. This leads to a bulky printed board and an increase in the number of connectors, and consequently to an increase in cost.

When a diode is used as the temperature detection element, a small voltage change caused by the temperature characteristic (−2 mV/C°) of the forward voltage of a PN junction needs to be detected. On the element substrate, however, digital signal lines configured to transfer a data signal, a clock signal, and the like are arranged adjacent to the temperature detection signal line. Noise from the digital signals is superimposed on the temperature detection signal, resulting in an error in the detected temperature. In particular, since the full-line printhead has a large width, the temperature detection signal line to each element substrate needs to be led a long distance. Hence, the temperature detection signal line is readily affected by other signal lines, and noise is readily superimposed.

SUMMARY OF THE INVENTION

Accordingly, the present invention is conceived as a response to the above-described disadvantages of the conventional art.

For example, a printhead and a printing apparatus including the printhead according to this invention are capable of reducing cost by suppressing the number of terminals and the number of wires in an arrangement including a plurality of element substrates respectively integrated with temperature detection elements, and accurately performing temperature detection.

According to one aspect of the present invention, there is provided a printhead in which a plurality of element substrates each including a plurality of printing elements are arranged in an arrayed direction of the plurality of printing elements. The printhead comprises: a temperature detection element provided on each of the plurality of element substrates and configured to detect a temperature of the each of the plurality of element substrates; a head control IC connected to each of the plurality of element substrates and configured to control driving of the plurality of printing elements integrated on the plurality of element substrates; signal wires configured to transfer a signal between the head control IC and each of the plurality of element substrates; and a head terminal configured to connect the signal wire to the head control IC and each of the plurality of element substrates. A temperature detection signal output from the temperature detection element and an image data signal are multiplexed on part of the signal wires.

According to another aspect of the present invention, there is provided a printing apparatus that performs printing using a printhead having the above-described arrangement.

The invention is particularly advantageous since it is possible to suppress an increase in the number of head terminals and the number of wires and implement an inexpensive printhead. It is also possible to effectively reduce a noise signal superimposed on the temperature detection signal output from the temperature detection element and improve the temperature detection accuracy.

Further features of the present invention will become apparent from the following description of exemplary embodiments (with reference to the attached drawings).

DESCRIPTION OF THE EMBODIMENTS

Figure 1:
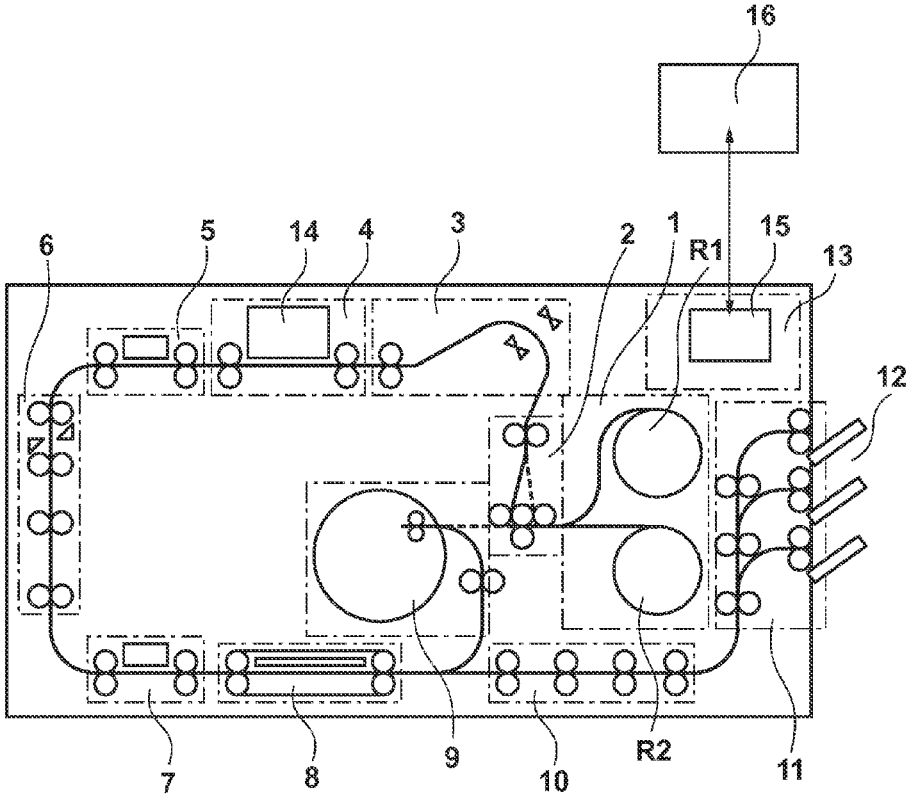
FIG. 1 is a schematic side sectional view showing the internal arrangement of an inkjet printing apparatus according to an exemplary embodiment of the present invention.

Exemplary embodiments of the present invention will now be described in detail in accordance with the accompanying drawings. Note that the same reference numerals denote already explained parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

An element substrate (head substrate) for a printhead to be used below indicates not a mere base made of silicon semiconductor but a component provided with elements, wirings, and the like.

"On the substrate" not only simply indicates above the element substrate but also indicates the surface of the element substrate and the inner side of the element substrate near the surface. In the present invention, "built-in" is a term not indicating simply arranging separate elements on the substrate surface as separate members but indicating integrally forming and manufacturing the respective elements on the element substrate in, for example, a semiconductor circuit manufacturing process.

An embodiment of an inkjet printing apparatus will be described next. This printing apparatus is a high-speed line printer that uses a continuous sheet (print medium) wound into a roll and supports both single-sided printing and double-sided printing. The printing apparatus is suitable for, for example, a mass print field in a print laboratory or the like.

FIG. 1 is a side sectional view showing the schematic internal arrangement of an inkjet printing apparatus (to be referred to as a printing apparatus hereinafter) according to an exemplary embodiment of the present invention. The interior of the apparatus can roughly be divided into a sheet supply unit 1, a decurling unit 2, a skew adjustment unit 3, a print unit 4, a cleaning unit (not shown), an inspection unit 5, a cutter unit 6, an information printing unit 7, a drying unit 8, a sheet winding unit 9, a discharge conveyance unit 10, a sorter unit 11, a discharge tray 12, a control unit 13, and the like. A sheet is conveyed by a conveyance mechanism including roller pairs and a belt along a sheet conveyance path indicated by the solid line in FIG. 1 and undergoes processing of each unit.

The sheet supply unit 1 stores and supplies a continuous sheet wound into a roll. The sheet supply unit 1 can store two rolls R1 and R2, and is configured to selectively draw and supply a sheet. Note that the number of storable rolls is not limited to two, and one or three or more rolls may be stored. The decurling unit 2 reduces the curl (warp) of the sheet supplied from the sheet supply unit 1. The decurling unit 2 bends and strokes the sheet so as to give a warp in an opposite direction to the curl using two pinch rollers with respect to one driving roller, thereby reducing the curl. The skew adjustment unit 3 adjusts the skew (tilt with respect to the original traveling direction) of the sheet that has passed through the decurling unit 2. A sheet end on a reference side is pressed against a guide member, thereby adjusting the skew of the sheet.

The print unit 4 forms an image on the conveyed sheet by a printhead unit 14. The print unit 4 also includes a plurality of conveyance rollers configured to convey the sheet. The printhead unit 14 includes a full-line printhead (inkjet printhead) in which an inkjet nozzle array is formed within a range covering the maximum width of sheets assumed to be used. In the printhead unit 14, a plurality of printheads are arranged parallelly along the sheet conveyance direction. In this embodiment, the printhead unit 14 includes four printheads corresponding to four colors of K (black), C (cyan), M (magenta), and Y (yellow). The printheads are arranged in the order of K, C, M, and Y from the upstream side of sheet conveyance. Note that the number of ink colors and the number of printheads are not limited to four. As the inkjet method, a method using heating elements, a method using piezoelectric elements, a method using electrostatic elements, a method using MEMS elements, or the like can be employed. The respective color inks are supplied from ink tanks to the printhead unit 14 via ink tubes.

The inspection unit 5 optically reads an inspection pattern or image printed on the sheet by the print unit 4, and inspects the states of nozzles of the printheads, the sheet conveyance state, the image position, and the like. The inspection unit 5 includes a scanner unit that actually reads an image and generates image data, and an image analysis unit that analyzes the read image and returns the analysis result to the print unit 4. The inspection unit 5 includes a CCD line sensor which is arranged in a direction perpendicular to the sheet conveyance direction.

Figure 2:
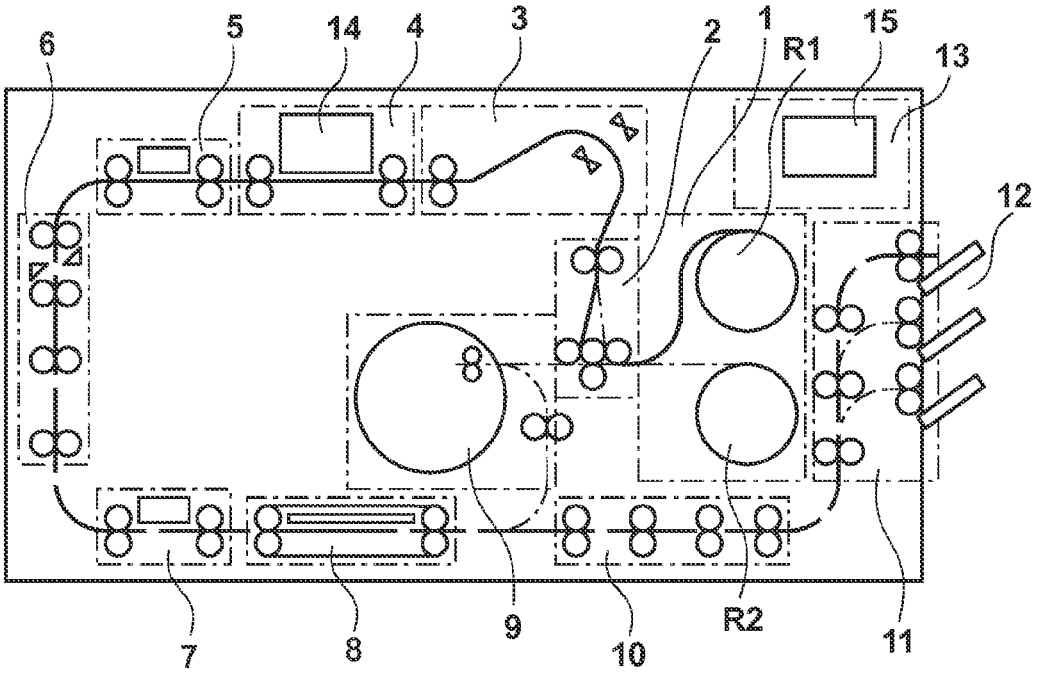
FIG. 2 is a view for explaining the single-sided printing operation of the printing apparatus shown in FIG. 1.
Figure 3:
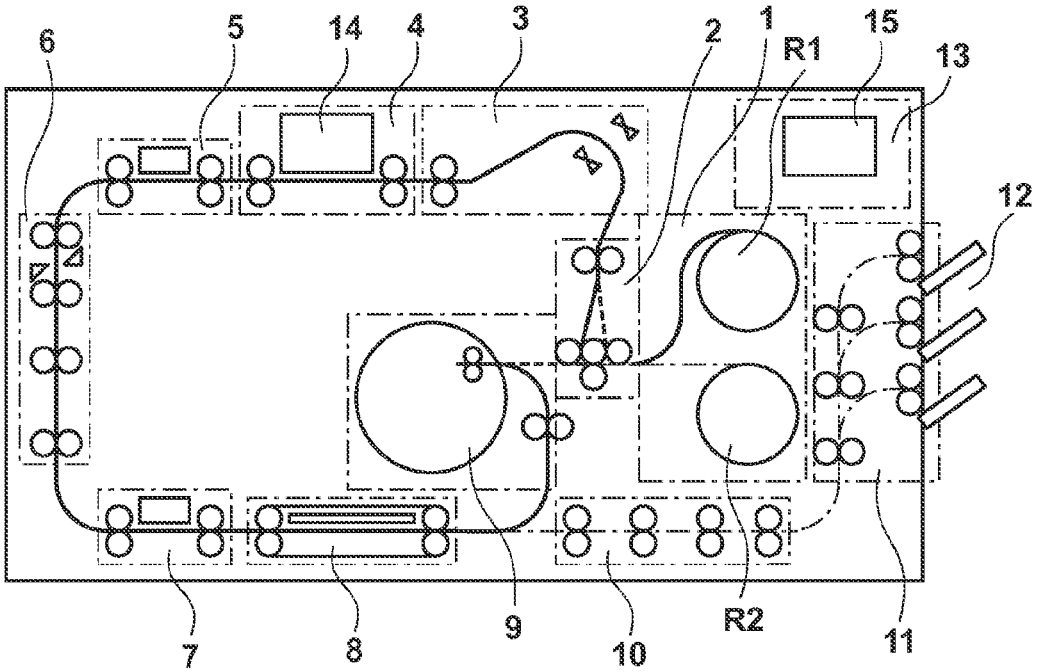
FIG. 3 is a view for explaining the double-sided printing operation of the printing apparatus shown in FIG. 1.

Note that the printing apparatus shown in FIG. 1 supports both single-sided printing and double-sided printing, as described above. FIGS. 2 and 3 are views for explaining the single-sided printing operation and double-sided printing operation of the printing apparatus shown in FIG. 1, respectively.

Several embodiments of the full-line printhead included in the printing apparatus having the above-described arrangement will be described next.

[First Embodiment]

Figure 4:
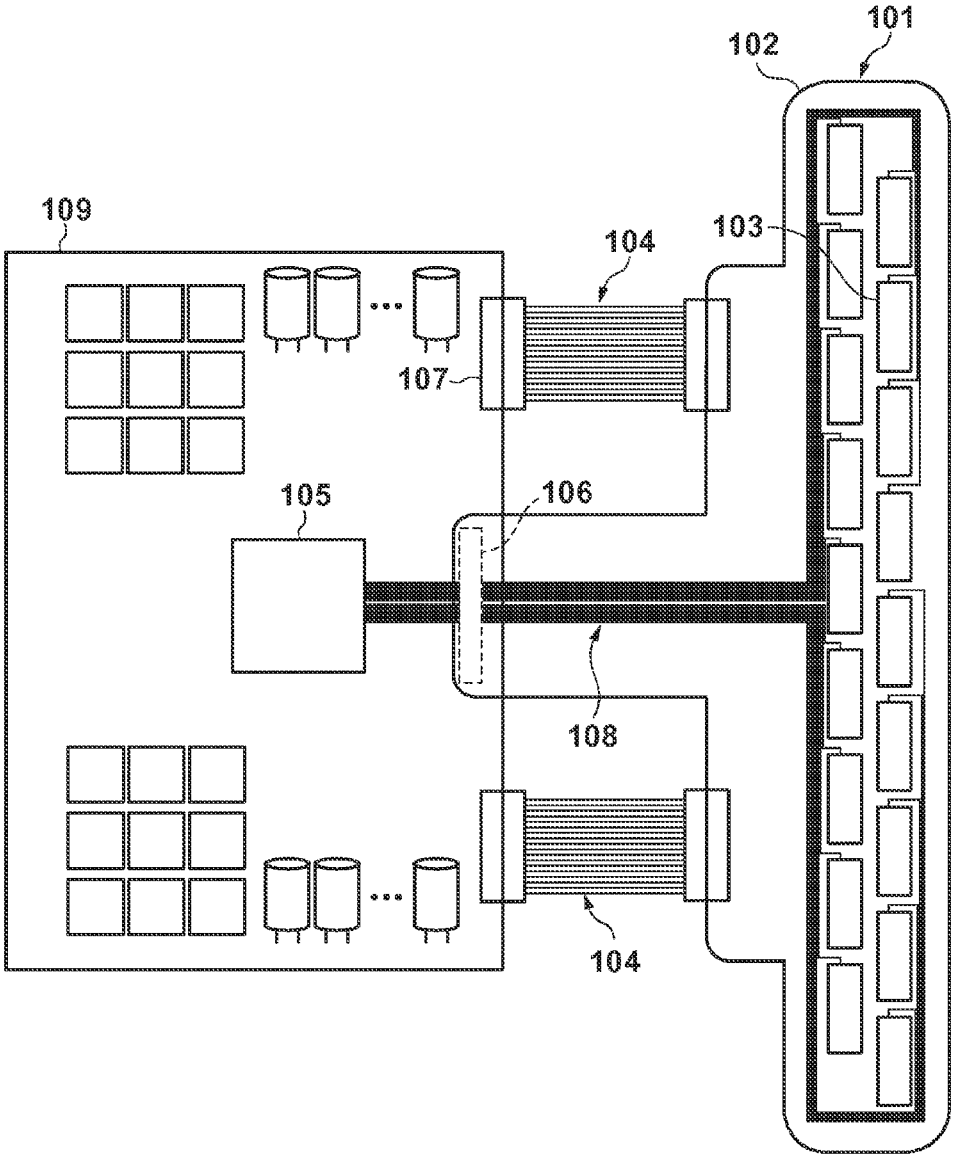
FIG. 4 is a view showing the schematic arrangement of a full-line printhead.

FIG. 4 is a view showing the schematic arrangement of a full-line printhead.

As shown in FIG. 4, a plurality of element substrates 103 are arranged zigzag on a printed board 102 in a full-line printhead 101 and electrically connected to a head control substrate 109 via a first connector 106, cables 104, and second connectors 107. A plurality of printing elements are integrated on each element substrate 103. The plurality of element substrates are arranged in the arrayed direction of the printing elements, thereby attaining a print width corresponding to a width of a print medium. A data signal and a clock signal used to drive the element substrates 103 are generated by a head control IC 105 on the head control substrate 109 and supplied to each of the element substrates 103 via a signal wire 108. A temperature detection element configured to detect the temperature of an element substrate is integrated on each element substrate 103. An analog temperature detection signal represented by a voltage output from the temperature detection element is read by the head control IC 105, thereby detecting the temperature of each element substrate 103. The temperature detection signal is supplied to the head control substrate 109 via the signal wire 108.

Figure 5:
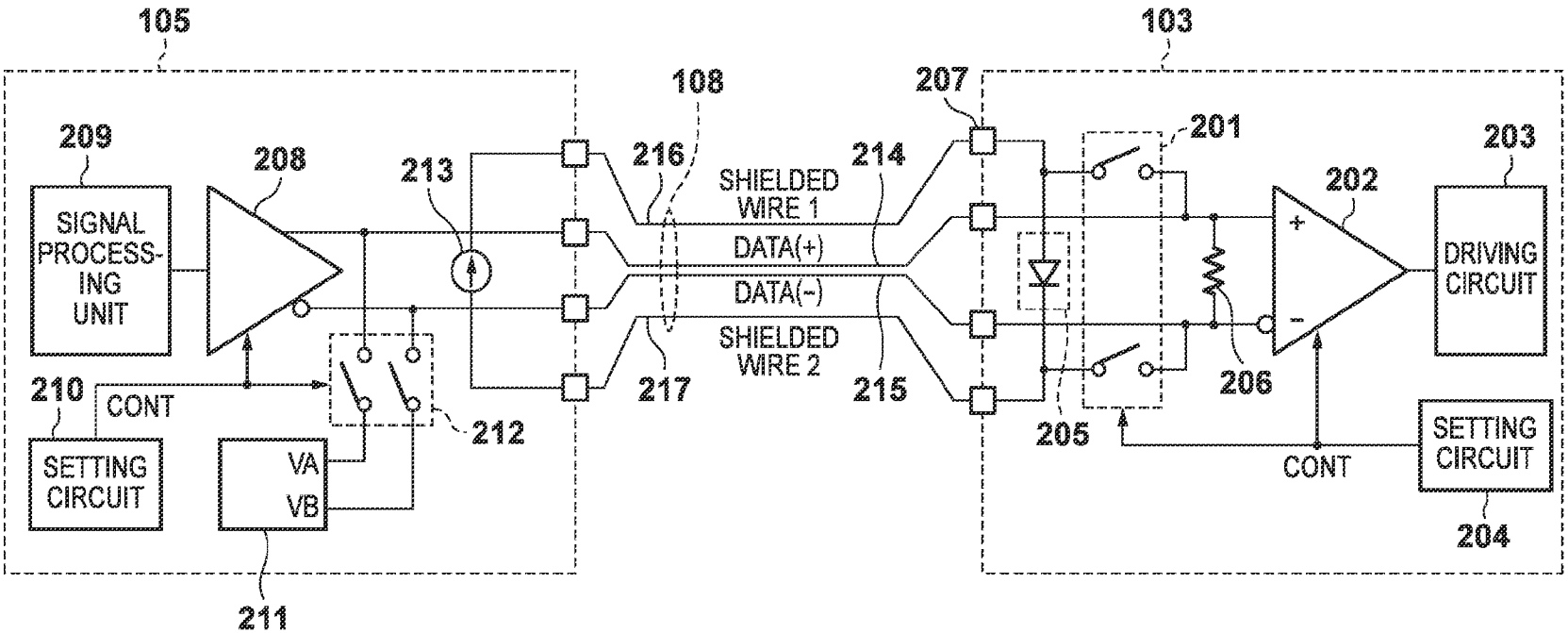
FIG. 5 is a circuit diagram showing the circuit arrangement of a full-line printhead according to the first embodiment.

FIG. 5 is a circuit diagram showing the circuit arrangement of the full-line printhead according to the first embodiment.

Only one element substrate 103 and the head control IC 105 are illustrated here for the descriptive convenience. Actually, the full-line printhead includes a plurality of (in the example of FIG. 4, 18) element substrates.

The element substrate 103 shown in FIG. 5 is used in the printhead unit 14 of the printing apparatus shown in FIGS. 1 to 3. The head control IC 105 controls driving of the element substrate. The element substrate 103 includes a differential signal reception unit 202, a driving circuit 203, and a temperature detection element 205. The temperature detection element 205 is a PN-junction diode, and detects the forward voltage of the diode.

On the other hand, the head control IC 105 includes a signal processing unit 209, a differential signal transmission unit 208 configured to convert a signal output from the signal processing unit 209 into a differential signal, and an A/D conversion unit 211 configured to convert a voltage as an analog temperature detection signal output from the temperature detection element 205 into a digital signal. The head control IC 105 also includes a DC current source 213 configured to supply a forward current to the temperature detection element 205.

The element substrate 103 causes the differential signal reception unit 202 to receive, via the signal wire 108, an image data signal (DATA) and a clock signal (CLK) output from the differential signal transmission unit 208 and drive the driving circuit 203. As each of the image data signal (DATA) and the clock signal (CLK), an LVDS (low voltage differential signal) that is a differential signal having a small amplitude and is capable of high-speed transfer is used. Only the image data signal (DATA) is illustrated here for the descriptive convenience.

Note that reference numeral 207 denotes a head terminal. In the example of FIG. 5, four head terminals are provided on the element substrate side, and four head terminals are provided on the head control IC side.

Figure 6:
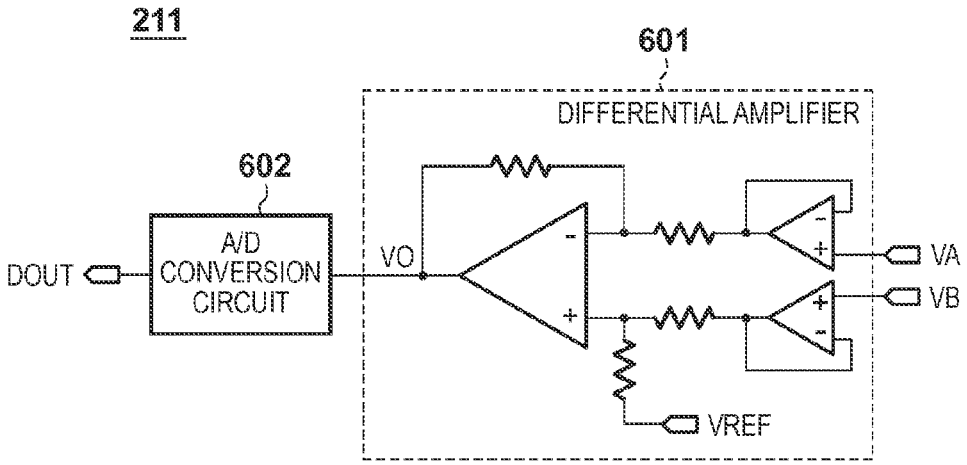
FIG. 6 is a circuit diagram showing the detailed circuit arrangement of an A/D conversion unit 211.

FIG. 6 is a circuit diagram showing the detailed circuit arrangement of the A/D conversion unit 211.

As shown in FIG. 6, the A/D conversion unit 211 is formed from a differential amplifier 601 and an A/D conversion circuit 602. The differential amplifier 601 amplifies a voltage difference between a first input voltage VA and a second input voltage VB, and outputs a temperature information voltage VO of the element substrate to the A/D conversion circuit 602. The A/D conversion circuit 602 converts the temperature information voltage VO into digital temperature information DOUT.

Figure 7A:
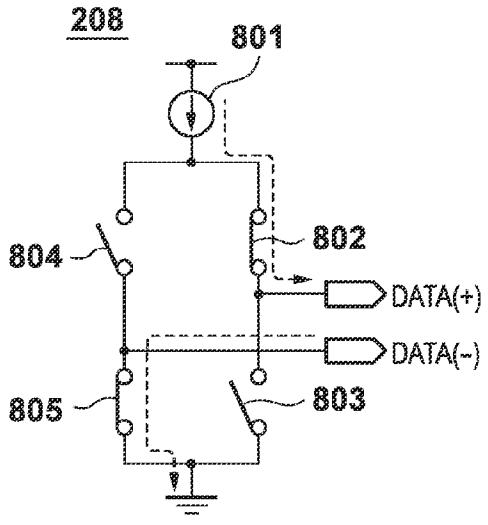
FIGS. 7A, 7B, and 7C are circuit diagrams showing the detailed circuit arrangement of a differential signal transmission unit 208.
Figure 7B:
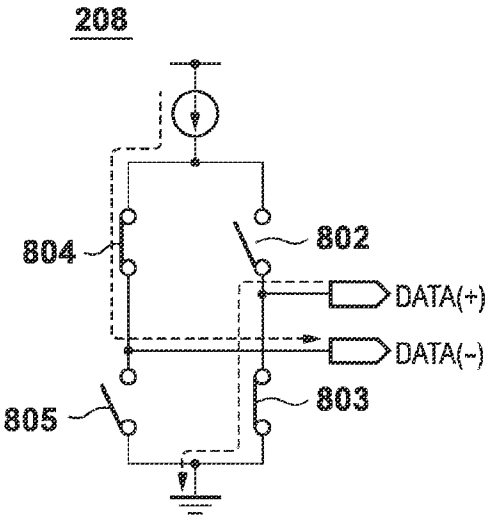
Figure 7C:
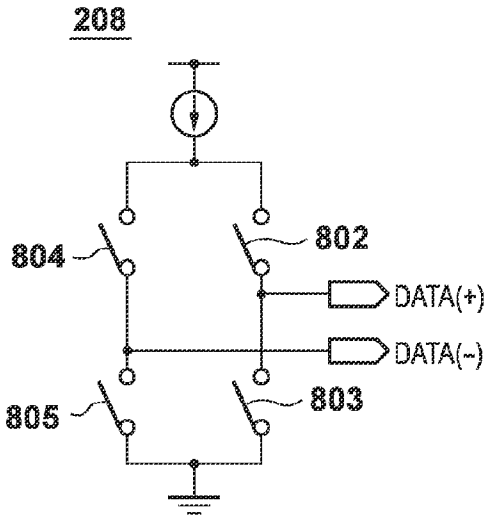

FIGS. 7A to 7C are circuit diagrams showing the detailed circuit arrangement of the differential signal transmission unit 208.

As shown in FIGS. 7A to 7C, the differential signal transmission unit 208 is formed from a constant current source 801 and four switches 802 to 805.

FIG. 7A is a circuit diagram showing the operation of the differential signal transmission unit 208 when the image data signal (DATA) is high level (High). According to FIG. 7A, the switches 802 and 805 are turned on, and a current from the DATA (+) terminal flows through a differential signal wire 214, a terminating resistor 206, and a differential signal wire 215 shown in FIG. 5 and returns to the DATA (−) terminal.

FIG. 7B is a circuit diagram showing the operation of the differential signal transmission unit 208 when the image data signal (DATA) is low level (Low). According to FIG. 7B, the switches 803 and 804 are turned on, and a current from the DATA (−) terminal flows through the differential signal wire 215, the terminating resistor 206, and the differential signal wire 214 shown in FIG. 5 and returns to the DATA (+) terminal.

FIG. 7C is a circuit diagram showing the states of the switches 802 to 805 when the temperature detection signal output from the temperature detection element 205 is transferred (temperature detection signal transfer mode). In this case, all the switches 802 to 805 are turned off, and the differential signal transmission unit 208 does not output a differential signal. At this time, both switches 201 and 212 are switched over to an on state, and the temperature detection signal can be output from the element substrate 103 to the head control IC 105.

The signal wire 108 connects the element substrate 103 and the head control IC 105, and is formed from a printed board or the like serving as a signal transmission line. As shown in FIG. 5, the signal wire 108 includes the two differential signal wires 214 and 215 and two shielded wires 216 and 217.

Figure 8:
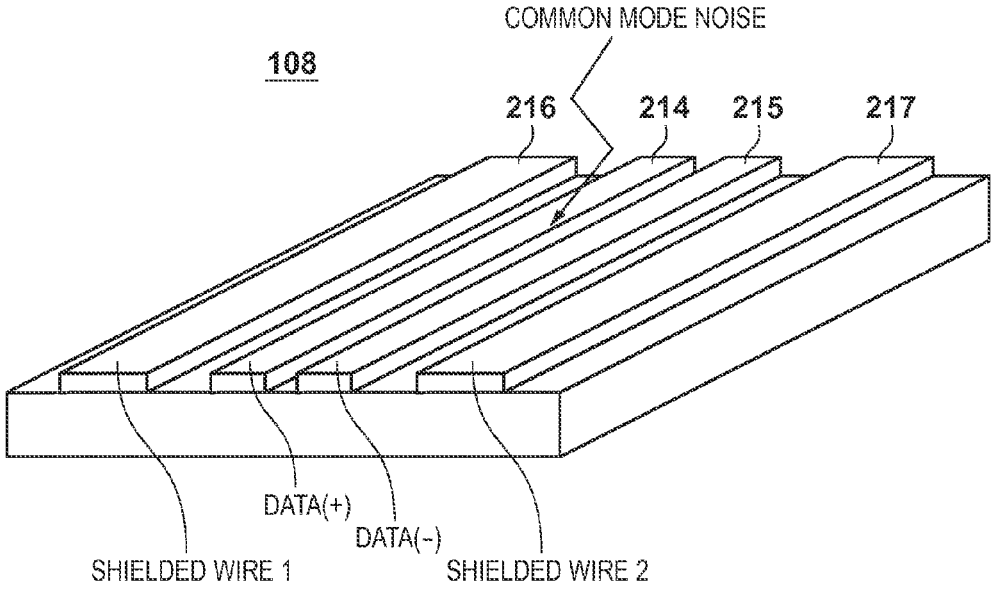
FIG. 8 is a sectional perspective view of a signal wire 108 on a printed board 102.

FIG. 8 is a sectional perspective view of the signal wire 108 on the printed board 102.

As shown in FIG. 8, the differential signal wires 214 and 215 are installed adjacently on the printed board 102 such that their wiring lengths are equal to each other. In addition, the signal wire widths and signal wire interval of the differential signal wires 214 and 215 are adjusted such that the differential impedance matches the terminating resistor 206. The shielded wires 216 and 217 have a function of preventing the differential signal wires 214 and 215 from being affected by crosstalk or electromagnetic noise from an adjacent signal wire or power supply wire (not shown). Hence, the LVDS standard recommends installing the shielded wires in parallel to the differential signal wires.

In the full-line printhead according to this embodiment, the image data signal (DATA) and the temperature detection signal output from the temperature detection element 205 are multiplexed on the differential signal wires 214 and 215. For this reason, as shown in FIG. 5, the element substrate 103 is provided with the switch 201 and a setting circuit 204. In addition, the head control IC 105 is also provided with the switch 212 and a setting circuit 210. The switches 201 and 212 perform the on/off operation in accordance with the logical levels of control signals (CONT) output from the setting circuits 204 and 210. The control signals (CONT) output from the setting circuits 204 and 210 synchronize with each other. For example, when the control signals (CONT) are low level, the switches 201 and 212 are turned off. This switchover allows the head control IC 105 to output the image data signal (DATA) and the like to the element substrate 103. When the control signals (CONT) are high level, the switches 201 and 212 are turned on. This switchover allows the element substrate 103 to output the temperature detection signal to the head control IC 105.

Figure 9:
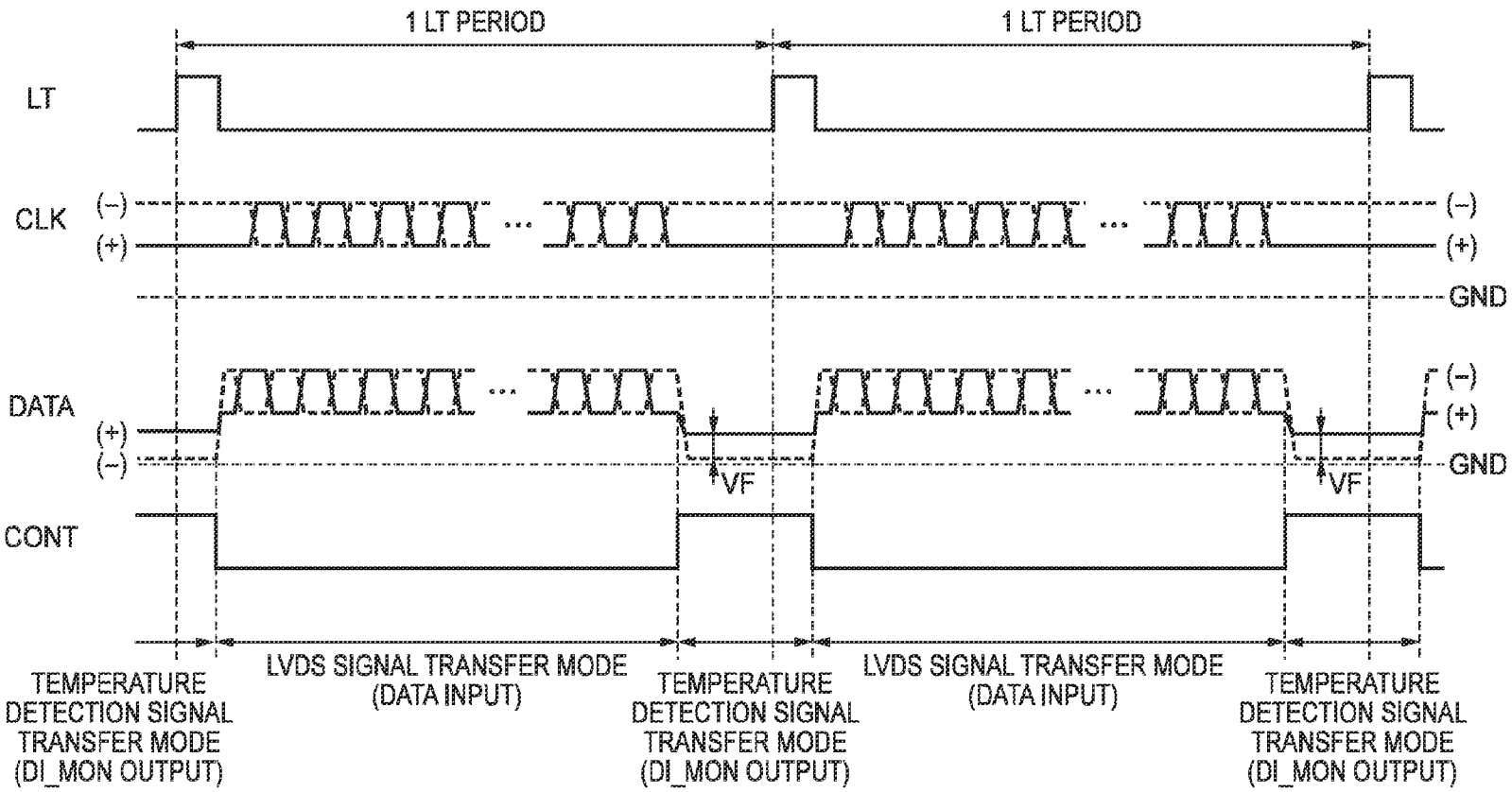
FIG. 9 is a timing chart of signals used for the operation of the full-line printhead according to the first embodiment.

FIG. 9 is a timing chart of signals used for the operation of the full-line printhead according to the first embodiment.

FIG. 9 shows the timing relationship between the clock signal (CLK), image data signal (DATA), latch signal (LT), and control signal (CONT). The image data signal (DATA) is a differential LVDS signal. The (+) component is a non-inverted signal and corresponds to the differential signal wire 214. The (−) component is an inverted signal and corresponds to the differential signal wire 215. The image data signal (DATA) is transferred in synchronism with the clock signal (CLK). When the transfer ends, the latch signal (LT) is transferred, and a latch circuit provided in the driving circuit 203 holds the image data signal (DATA).

A detailed operation of the full-line printhead according to this embodiment will be described next with reference to FIGS. 5 and 9.

When the transfer of the image data signal (DATA) from the head control IC 105 to the element substrate 103 ends, the setting circuit 204 outputs the control signal (CONT) whose logical level is high. In accordance with the control signal (CONT), the differential signal reception unit 202 becomes inactive, and the switch 201 is turned on to output the anode voltage of the diode serving as the temperature detection element to the differential signal wire 214 and the cathode voltage to the differential signal wire 215. At the same time, the setting circuit 210 also outputs the control signal (CONT) whose logical level is high. Accordingly, the differential signal transmission unit 208 becomes inactive, and the switch 212 is turned on to connect the differential signal wires 214 and 215 to the A/D conversion unit 211. The A/D conversion unit 211 converts the differential voltage between the anode voltage and the cathode voltage into a digital value and acquires the temperature information of the element substrate 103.

After that, the setting circuits 204 and 210 simultaneously output the control signal (CONT) whose logical level is low. In accordance with the control signal (CONT), the switches 201 and 212 are turned off, the differential signal reception unit 202 and the differential signal transmission unit 208 become active, and the image data signal (DATA) is transferred from the head control IC 105 to the element substrate 103. With this operation, the full-line printhead can time-divisionally multiplex the image data signal (DATA) and the temperature detection signal on the differential signal wires 214 and 215 as part of the signal wire 108.

Figure 10:
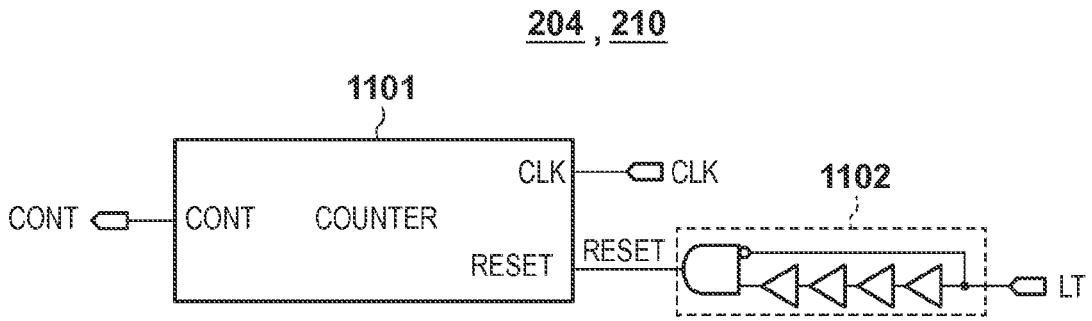
FIG. 10 is a circuit diagram showing the detailed circuit arrangement of a setting circuit 204.

FIG. 10 is a circuit diagram showing the detailed circuit arrangement of the setting circuits 204 and 210.

As shown in FIG. 10, each of the setting circuits 204 and 210 includes a counter circuit 1101 configured to count the signal pulses of the clock signal (CLK) serving as a reference, and a reset circuit 1102.

Figure 11:
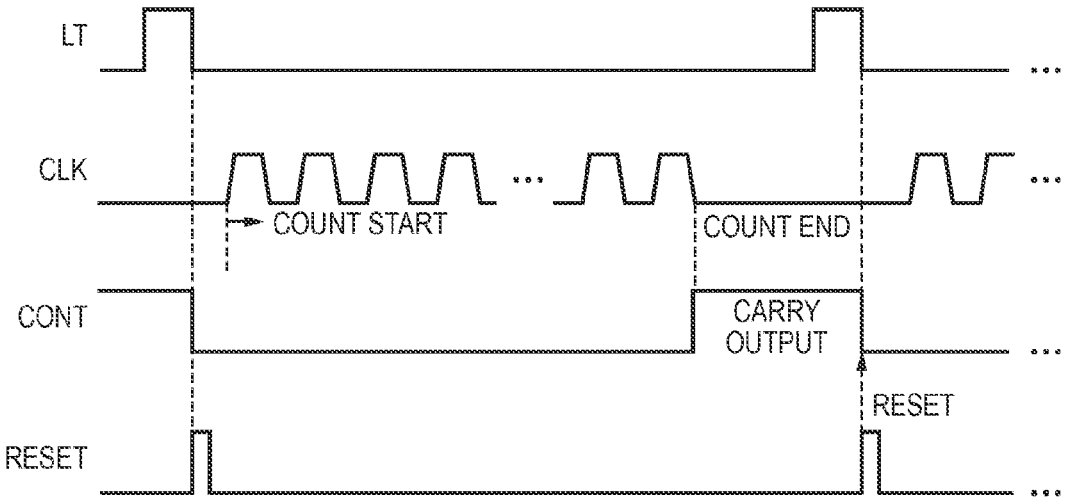
FIG. 11 is a timing chart showing the operation of the setting circuit 204.

FIG. 11 is a timing chart showing the operation of the setting circuits 204 and 210.

According to FIG. 11, when the clock signal (CLK) is input a predetermined number of times, and a count value counted by the counter circuit 1101 reaches a predetermined value, the counter circuit 1101 outputs a carry signal. After that, the reset circuit 1102 outputs a reset signal (RESET) at the trailing edge of the latch signal (LT) and resets the counter circuit 1101. As described above, the setting circuits 204 and 210 generate the control signals (CONT) from the same clock signal (CLK) and latch signal (LT), and can therefore operate in synchronism with each other.

In the full-line printhead having the above-described arrangement, the image data signal (DATA) and the temperature detection signal are time-divisionally multiplexed on the same differential signal wires, thereby producing three large effects. First, the number of wires and the number of head terminals can be decreased. Second, the noise signal superimposed on the temperature detection signal can be reduced. Third, the accuracy of the temperature detection signal can be improved.

The three effects will be explained below with reference to a comparative example.

(1) Decrease of Number of Wires and Number of Head Terminals

Figure 12:
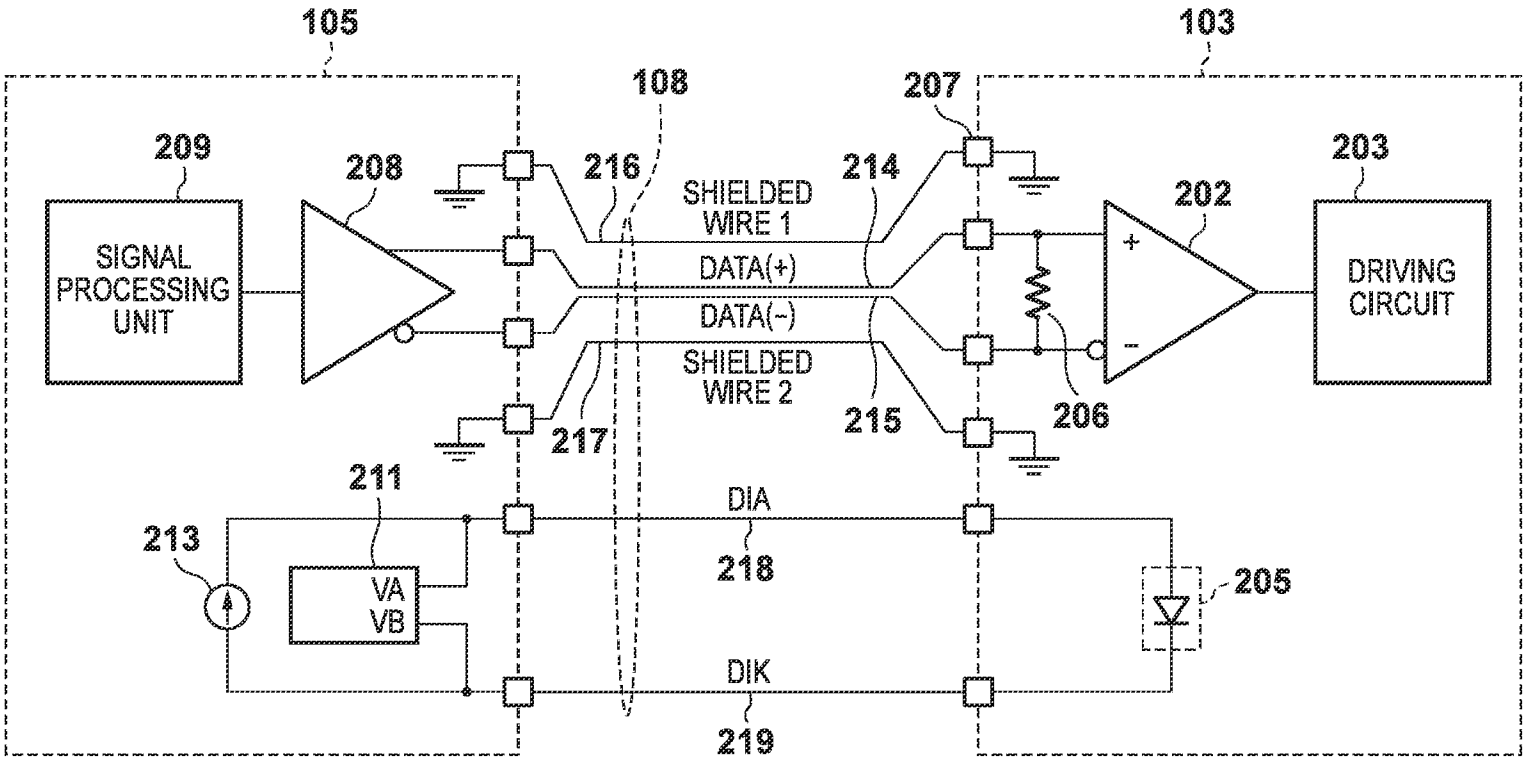
FIG. 12 is a circuit diagram showing the circuit arrangement of a conventional full-line printhead as a comparative example.

FIG. 12 is a circuit diagram showing the circuit arrangement of a conventional full-line printhead as a comparative example.

Note that the same reference numerals as those already described with reference to FIG. 5 denote the same constituent elements in FIG. 12, and a description thereof will be omitted.

As shown in FIG. 12, since the conventional full-line printhead needs to separately include wires 218 and 219 for temperature detection signals (DIA and DIK), two wires are necessary for each element substrate as temperature detection wires. For this reason, when 18 element substrates are integrated on the full-line printhead, as shown in FIG. 4, 36 wires are necessary, and 36 head terminals are necessary. On the other hand, in the full-line printhead according to this embodiment, since the temperature detection signal is time-divisionally multiplexed on the differential signal wires 214 and 215, as shown in FIG. 5, it is not necessary to separately provide dedicated wires for the temperature detection signal. Hence, the number of wires and the number of head terminals can be decreased.

(2) Reduction of Noise Signal Superimposed on Temperature Detection Signal

In the full-line printhead according to this embodiment, as shown in FIG. 8, the temperature detection signal is transferred by the differential signal wires that are installed adjacently and have the same wiring length. For this reason, even if external noise is superimposed on the temperature detection signal, symmetric noise waveforms are obtained on the anode and cathode sides, and the noise can be removed by calculating the differential voltage by the differential amplifier (common mode noise removal). In addition, when turning on the switch 201, the terminating resistor 206 connected in parallel with the temperature detection element 205 prevents the noise waveforms from becoming asymmetric in the vertical direction due to non-linearity of the diode. Furthermore, the shielded wires 216 and 217 prevent crosstalk noise from the adjacent wires to the temperature detection signal transferred to the differential signal wires 214 and 215. Hence, the full-line printhead according to this embodiment can effectively reduce the noise signal superimposed on the temperature detection signal.

(3) Improvement of Accuracy of Temperature Detection Signal

In the full-line printhead according to this embodiment, the wire that supplies the forward current to the temperature detection element 205 and the wire that reads the voltage of the temperature detection element are separated. It is therefore possible to measure the correct forward voltage of the temperature detection element by a 4-terminal method.

Figure 13A:
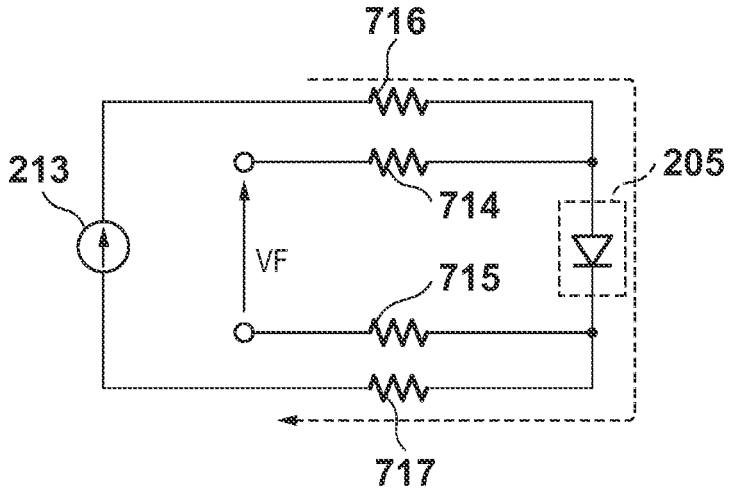
FIGS. 13A and 13B are circuit diagrams respectively showing an equivalent circuit of temperature detection of the full-line printhead according to the first embodiment and an equivalent circuit of temperature detection of the conventional full-line printhead as the comparative example.
Figure 13B:
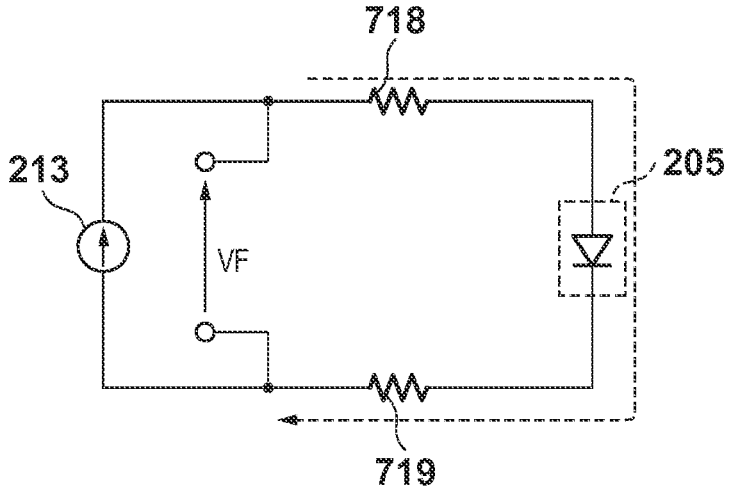

FIGS. 13A and 13B are circuit diagrams respectively showing an equivalent circuit of temperature detection of the full-line printhead according to this embodiment and an equivalent circuit of temperature detection of the conventional full-line printhead as the comparative example.

FIG. 13A shows an equivalent circuit of temperature detection of the full-line printhead according to this embodiment. FIG. 13B shows an equivalent circuit of temperature detection of the conventional full-line printhead. Referring to FIG. 13B, reference numerals 718 and 719 denote wiring resistances of the wires 218 and 219 (see FIG. 12) configured to transfer the temperature detection signal. In the conventional full-line printhead, the correct forward voltage (VF) of the temperature detection element 205 cannot be measured due to the voltage drop that occurs when the forward current flows to the wiring resistances 718 and 719.

On the other hand, in FIG. 13A, reference numerals 714 and 715 denote wiring resistances of the differential signal wires 214 and 215 (see FIGS. 5); 716 and 717, wiring resistances of the shielded wires 216 and 217 (see FIG. 8). In the full-line printhead according to this embodiment, since the forward current flows to the shielded wires 216 and 217, voltage drop by the wiring resistances 716 and 717 of the differential signal wires does not occur. Hence, since the forward voltage (VF) of the temperature detection element can correctly be read, the temperature detection signal can accurately be obtained.

Hence, according to the above-described embodiment, it is possible to implement a full-line printhead capable of preventing an increase in the number of head terminals and the number of wires and suppressing the cost. It is also possible to effectively reduce the noise signal superimposed on the temperature detection signal and improve the temperature detection accuracy.

[Second Embodiment]

Figure 14:
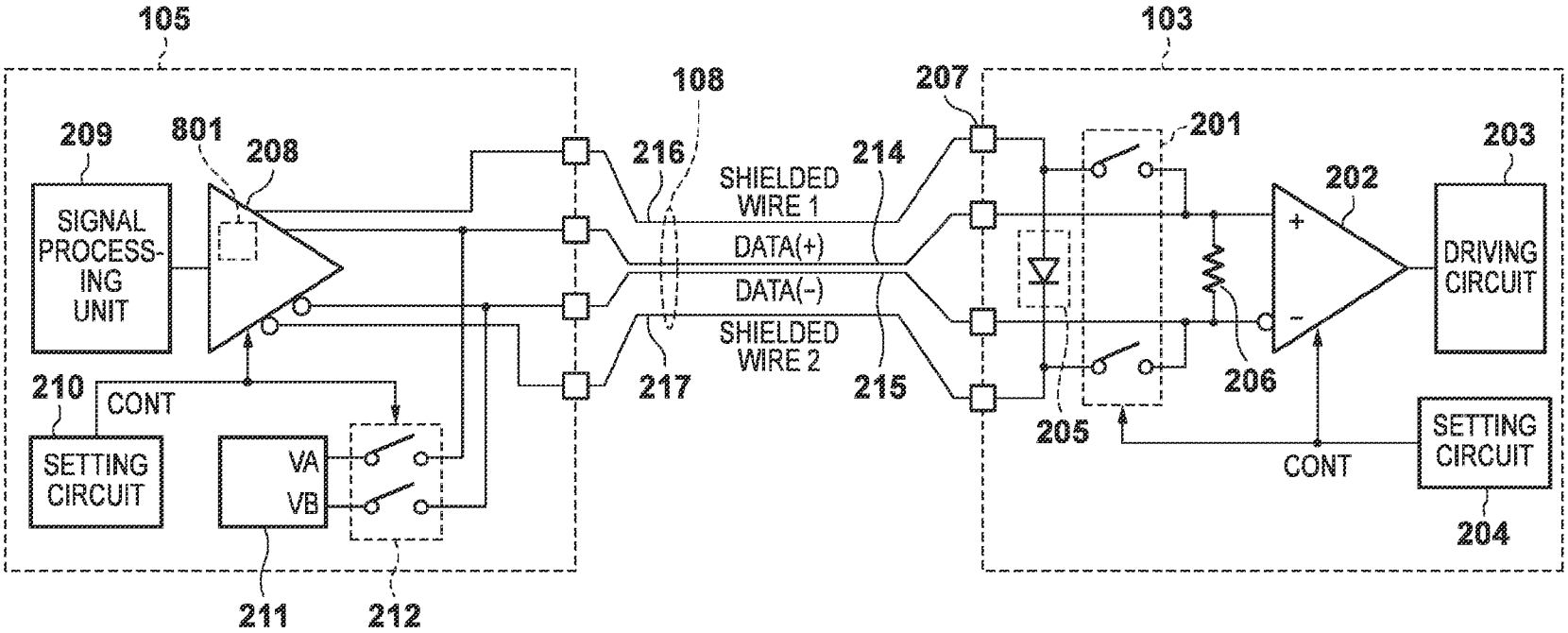
FIG. 14 is a circuit diagram showing the circuit arrangement of a full-line printhead according to the second embodiment.

FIG. 14 is a circuit diagram showing the circuit arrangement of a full-line printhead according to the second embodiment. Note that the same reference numerals and symbols as those already described with reference to FIG. 5 denote the same constituent elements and signals in FIG. 14, and a description thereof will be omitted.

As is apparent from comparison between FIG. 5 and FIG. 14, the forward current of a temperature detection element 205 is supplied from a constant current source 801 of a differential signal transmission unit 208, unlike the first embodiment.

Figures 15A, 15B, 15C:
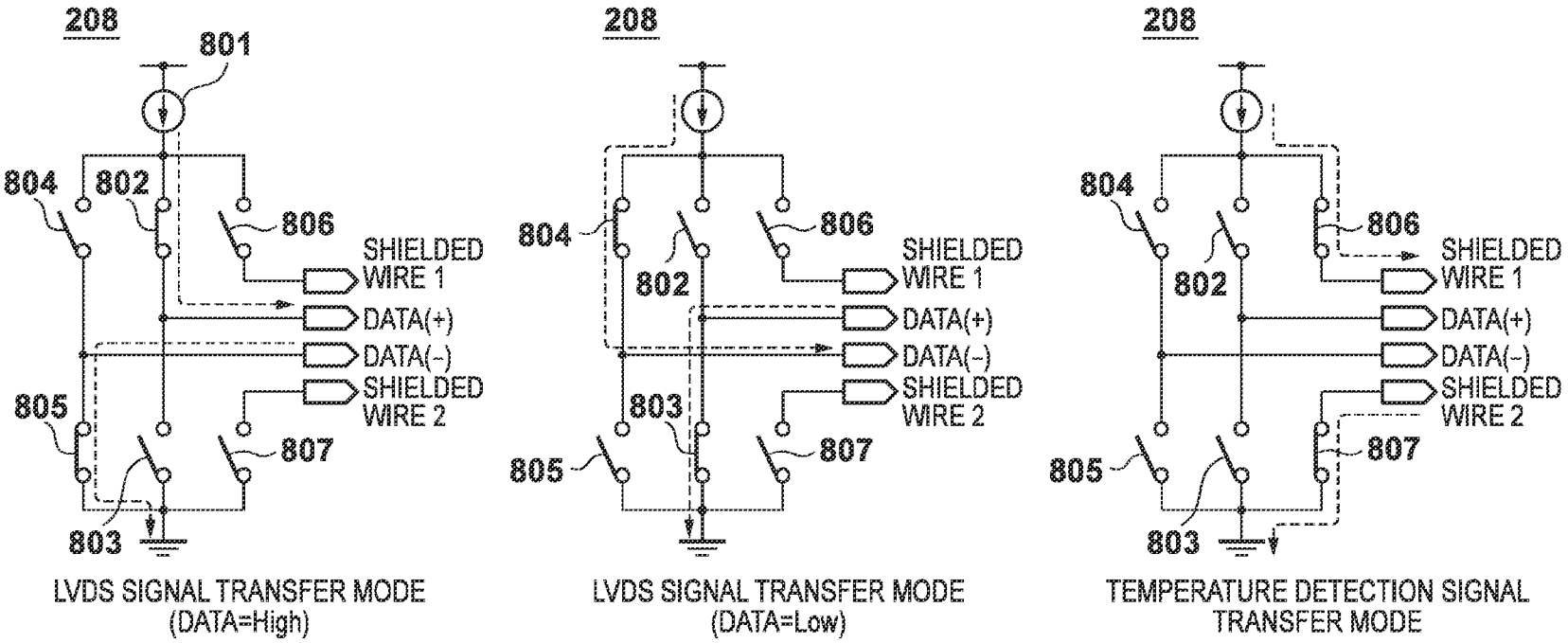
FIGS. 15A, 15B, and 15C are circuit diagrams showing the detailed circuit arrangement of a differential signal transmission unit 208 according to the second embodiment.

FIGS. 15A to 15C are circuit diagrams showing the detailed circuit arrangement of the differential signal transmission unit 208 according to the second embodiment. Note that the same reference numerals and symbols as those already described with reference to FIGS. 7A to 7C denote the same constituent elements and signals, in FIGS. 15A to 15C and a description thereof will be omitted.

As is apparent from comparison between FIGS. 7A to 7C and FIGS. 15A to 15C, switches 806 and 807 are added to the differential signal transmission unit 208 of this embodiment, unlike the first embodiment.

Especially, FIG. 15C shows the operation of the differential signal transmission unit when the logical level of a control signal (CONT) is high level (temperature detection signal transfer mode). According to FIG. 15C, the switches 806 and 807 are turned on, and the forward current is supplied from the constant current source 801 to the temperature detection element 205.

As described above, in the full-line printhead according to this embodiment, the forward current of the temperature detection element is supplied from the constant current source of the differential signal transmission unit. For this reason, the current source for supplying the forward current is unnecessary, and the circuit can be made compact, in terms of circuit area, as compared to the arrangement of the first embodiment.

The above-described element substrate is used in a full-line printhead. However, the present invention is not limited by this. For example, the element substrate may be used in the printhead of a serial printing apparatus that performs printing by scanning the printhead in a direction crossing the print medium conveyance direction. In the above-described example, a diode is used as the temperature detection element. However, the present invention is not limited by this. For example, a resistive element may be used as the temperature detection element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-097115, filed May 2, 2013, which is hereby incorporated by reference herein in its entirety.

What is claimed is:

1. A printhead in which a plurality of element substrates, each including a plurality of printing elements, is arranged in an arrayed direction of the plurality of printing elements, comprising:

a temperature detection element provided on each of the plurality of element substrates and configured to detect a temperature of said each of the plurality of element substrates;

a head control IC connected to each of the plurality of element substrates and configured to control driving of the plurality of printing elements integrated on the plurality of element substrates;

a first wire configured to transfer a signal produced by time-divisionally multiplexing a temperature detection signal output from said temperature detection element and an image data signal as a low voltage differential signal between said head control IC and each of the plurality of element substrates; and a second wire, provided in parallel to said first wire, configured to flow a current to said temperature detection element for temperature detection.

2. The printhead according to claim 1, wherein said first wire comprises differential signal wires installed so as to have a same wiring length.

3. The printhead according to claim 1, wherein said temperature detection element includes one of a diode and a resistive element.

4. The printhead according to claim 3, wherein each of said head control IC and the plurality of element substrates comprises a switch configured to switch over transmission and reception of the image data signal and the temperature detection signal.

5. The printhead according to claim 4, wherein said head control IC includes:

a differential signal transmission unit configured to transmit the image data signal to each of the plurality of element substrates as a differential signal, and said head control IC switches over said switch and outputs the image data signal in a case where the image data signal is transmitted, and switches over said switch and inputs the temperature detection signal in a case where the temperature detection signal is received.

6. The printhead according to claim 4, wherein each of the plurality of element substrates includes a differential signal reception unit configured to receive the image data signal as a differential signal, and each of the plurality of element substrates switches over said switch and causes said differential signal reception unit to receive the image data signal in a case where the image data signal is received, and switches over said switch and causes said temperature detection element to output the temperature detection signal in a case where the temperature detection signal is output.

7. The printhead according to claim 4, wherein each of said head control IC and the plurality of element substrates includes a setting circuit configured to control switchover of said switch.

8. The printhead according to claim 7, wherein said setting circuit includes:

a counter circuit configured to count a predetermined number of pulses of a clock signal; and a reset circuit configured to reset, based on a latch signal, a count value counted by said counter circuit.

9. The printhead according to claim 5, wherein said differential signal transmission unit includes a constant current source, and said constant current source supplies a forward current to be supplied to said diode.

10. The printhead according to claim 1, wherein the printhead comprises a full-line printhead in which the plurality of element substrates, each including the plurality of printing elements, is arranged in the arrayed direction of the plurality of printing elements and a print width corresponding to a width of a print medium is attained, and the full-line printhead is an inkjet printhead.

11. A printing apparatus for printing by using an inkjet printhead according to claim 10.

* * * * *